US005271498A

United States Patent [19]

Gillespie

[11] Patent Number: 5,271,498

[45] Date of Patent: Dec. 21, 1993

[54] MATTRESS PACKAGING SYSTEM

[75] Inventor: Robert F. Gillespie, Margate, Fla.

[73] Assignee: IBC Group, Inc., Ft. Lauderdale, Fla.

[21] Appl. No.: 943,178

[22] Filed: Sep. 14, 1992

[51] Int. Cl.[5] ..... B65D 85/62

[52] U.S. Cl. ..... 206/326; 206/497; 206/586

[58] Field of Search ..... 206/326, 497, 586; 5/448

[56] References Cited

U.S. PATENT DOCUMENTS 801,279 10/1905 Slyke ..... 206/326

4,865,201 9/1989 Liebel ..... 206/326

4,895,255 1/1990 Fisher ..... 206/497

OTHER PUBLICATIONS

Declaration of Robert F. Gillespie dated Dec. 13, 1992.

*Primary Examiner*—William I. Price

*Attorney, Agent, or Firm*—Roylance, Abrams, Berdo & Goodman

[57] ABSTRACT

A mattress package includes a set of superimposed mattresses. A base receives aligned lower ends of the mattresses, while a cap receives upper ends of the mattresses. Wrapping of elastic material is spirally wound around lateral sides of the set of mattresses and compresses the mattresses.

6 Claims, 4 Drawing Sheets

MATTRESS PACKAGING SYSTEM

FIELD OF THE INVENTION

The present invention relates to a packaging system for mattresses in which the formed package stands the mattresses on end and forms the plurality of mattress into a single unit which can be easily handled and efficiently stored. The package includes a set of superposed mattress with a base on their lower ends, a cap on their upper ends and a wrapping of elastic material about the lateral sides of the mattress set to compress the mattresses.

BACKGROUND OF THE INVENTION

Mattresses are typically individually stored and transported. This requires significant effort moving each individual piece from the manufacturing facility to the storage facility, from the storage facility into a vehicle, and from the vehicle into the storage facility at the retail outlet. Individual handling requires significant expenditure in labor and increases the risk of damaging the product. Even mounting the mattresses on pallets does not alleviate this problem.

SUMMARY OF THE INVENTION

An object of the present invention is to provide a packaging system for mattresses in which the plurality of mattresses can be formed into a stable package with the mattresses standing on end.

Another object of the present invention is to provide a package of a plurality of mattresses which can be easily stacked with one package on top of another package.

A further object of the present invention is to provide a packaging system which is simple and inexpensive to make, and provides packages which are easily handled and efficiently stored.

The forgoing objects are obtained by a mattress package comprising a set of superposed mattresses, a base receiving lower ends of the mattresses, and a cap receiving upper ends of the mattresses. A wrapping of elastic material is spirally wound about lateral sides of the mattress set and compresses the mattresses.

The forgoing objects are also obtained by a method of forming a mattress package, comprising the steps of mounting a base on a horizontal member of a rigid stand and abutting a vertical member of the stand, placing a plurality of mattresses on the base to form a superposed set with aligned lower ends of the mattresses received in the base and aligned upper ends remote from the base and with one lateral side of the set abutting the stand vertical member, mounting a cap on the upper ends of the mattresses, and spirally wounding elastic material about lateral sides of the set of mattress to compress the mattresses.

By forming the package in this manner, the base and cap protect the upper and lower ends. The wrapping compresses the mattresses and forms the mattresses into a single unit which can be easily handled and efficiently stored.

As used in this application, mattresses are intended to broadly include other similar bedding products such as foundations. Additionally, the terms upper, lower, and lateral sides used in this application to identify relative positions, and are not intended to limit the invention to any specific orientation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
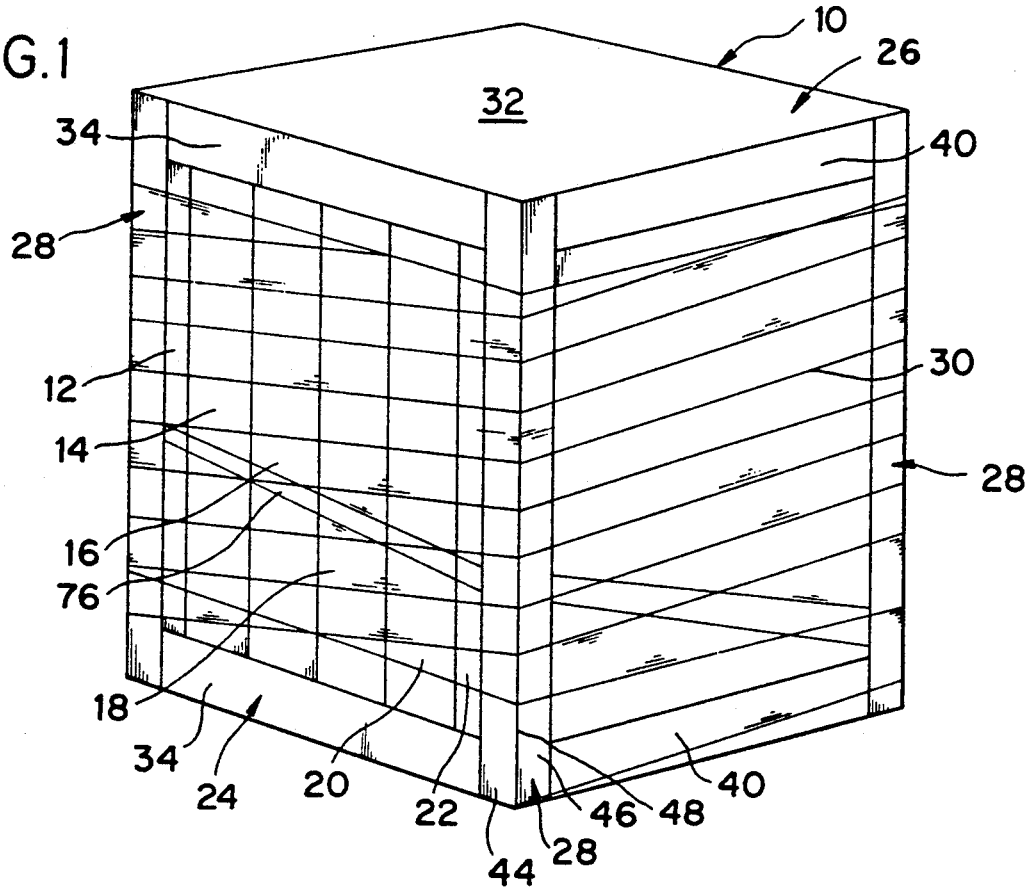
FIG. 1 is a perspective view of a mattress package according to the present invention.

Referring initially to FIG. 1, the mattress package according to the present invention is formed of six individual mattresses 12, 14, 16, 18, 20 and 22. The lower end of each mattress is received within a base 24. The upper end of each mattress is received within a cap 26. A plurality of edge supports 28 extend vertically and are attached to base 24 and cap 26. A wrapping 30 of elastic material is spirally wound about the lateral sides of the set of mattresses to compress the mattresses.

Base 24 and cap 26 are similarly constructed. The base (see FIG. 3) comprises a rectangular central panel 32 and four vertically extending walls 34, 36, 38 and 40. Each of these base walls are coupled to central panel 32 by a fold line. Walls 34 and 38 have flaps hingely attached to the longitudinal ends of such base walls by fold lines. Flaps 42 are attached to base walls 36 and 40 to form the open top box-like shape for the base. Flaps 42 and walls 40 and 36 are suitably attached, for example, by staples.

Since cap 26 is similarly formed, the construction of the cap is not explained in detailed. The corresponding features of cap 26 are identified with the same reference numerals.

Referring again to FIG. 1, each of the four vertically extending corner edges of the package is provided with an edge support 28. Each edge support includes two perpendicularly oriented panels 44 and 46 coupled along a fold line 48. The fold lines abut against the adjacent side edges of mattresses 12 and 22 such that panels 44 and 46 of each edge support overlie adjacent lateral sides of the set of the mattresses.

The edge supports, particularly when surrounded by wrapping 30, provide the vertical integrity necessary to permit the package to be solid, free standing unit. Additionally, the edge supports permit the packages to be stacked one upon the other.

Base 24, cap 26 and edge supports 28 are typically formed of corrugated cardboard. Each of these pieces are separately formed as flat panels with suitable cuts and score lines to permit them to easily formed as described herein.

Figure 2:
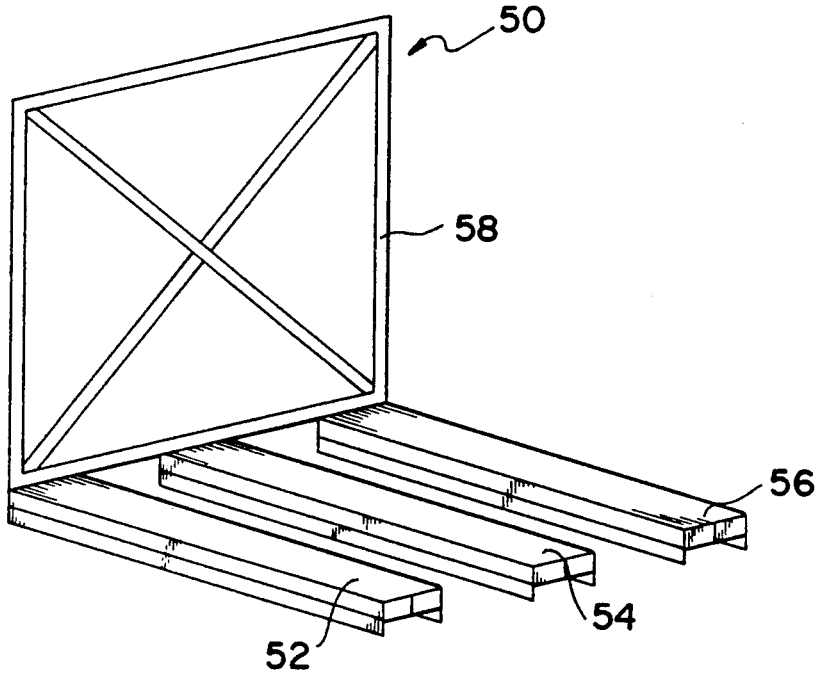
FIG. 2 is a perspective view of a stand for assembling the package of FIG. 1.

The package is initially formed using a stand 50 as illustrated in FIG. 2. Stand 50 is suitably formed of welded metal pieces and includes three horizontal members 52, 54, and 56. The horizontal members are oriented in the same plane, extend parallel to each other, and are laterally spaced from each other. The spacing and height of the horizontal members permit the use of forklifts for handling the packages.

A vertical member 58 is securely attached to the adjacent end of each horizontal member. The vertical member aids in supporting the mattresses while the package is being formed.

Figure 3:
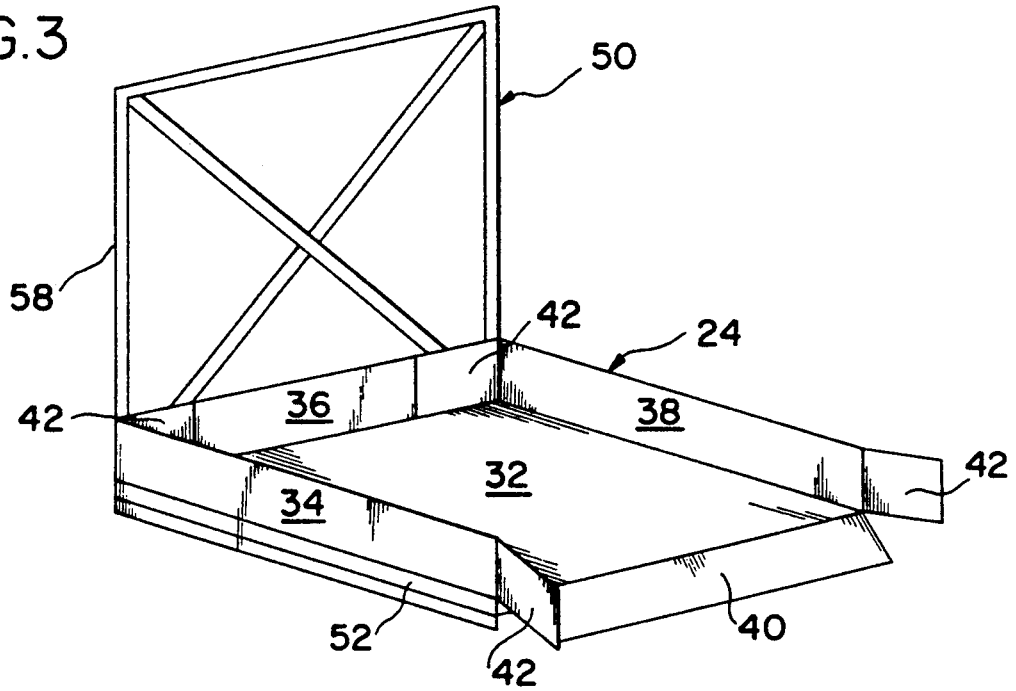
FIG. 3 is a perspective view of the stand of FIG. 2 with a base ready to receive a set of mattresses.

Base 24 is only partially formed and placed on stand 50 as illustrated in FIG. 3. The flaps 42 adjacent wall 36 are secured to wall 36 by staples. However, the flaps 42 adjacent wall 40 are left unattached, with wall 40 in a generally horizontal position and with flaps 42 adjacent thereto extending outwardly. In this configuration, the base facilitates the loading of the mattresses onto the stand and within base 24.

Figure 4:
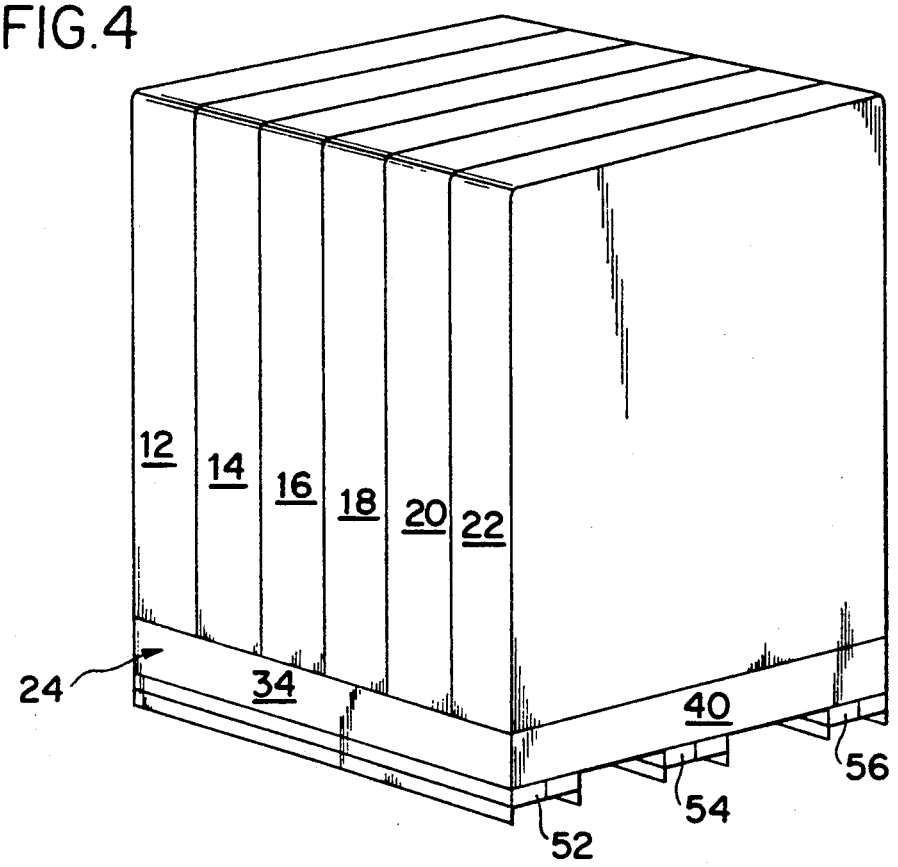
FIG. 4 is a perspective view of a set of mattresses mounted in the base on the stand of FIG. 3.
Figure 5:
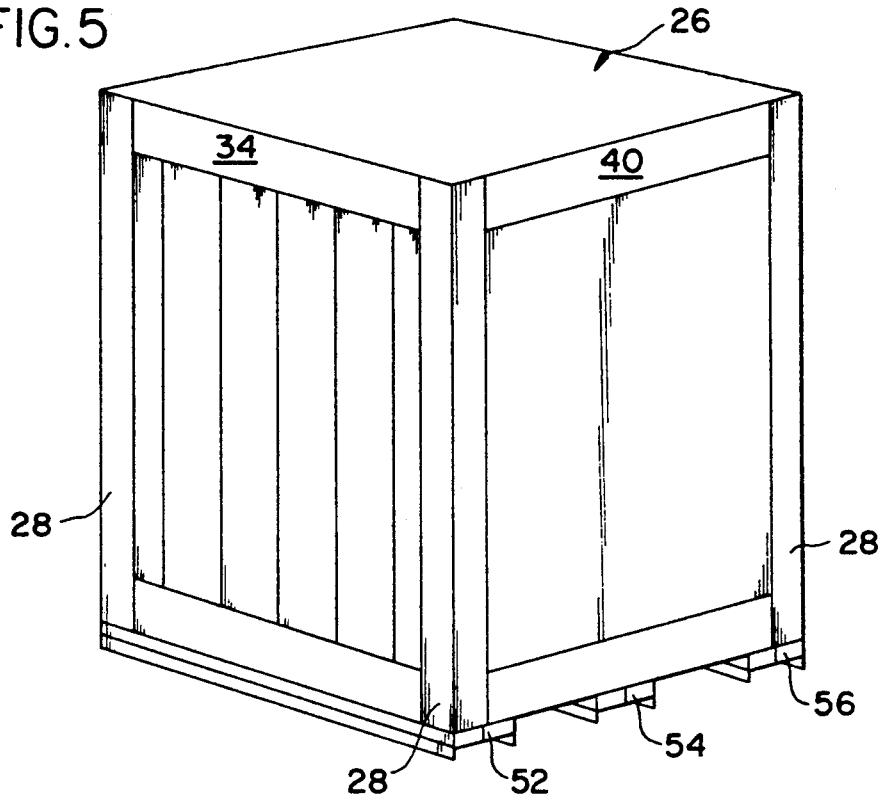
FIG. 5 is a perspective view of the set of mattresses of FIG. 4 with a cap and edge supports added.
Figure 6:
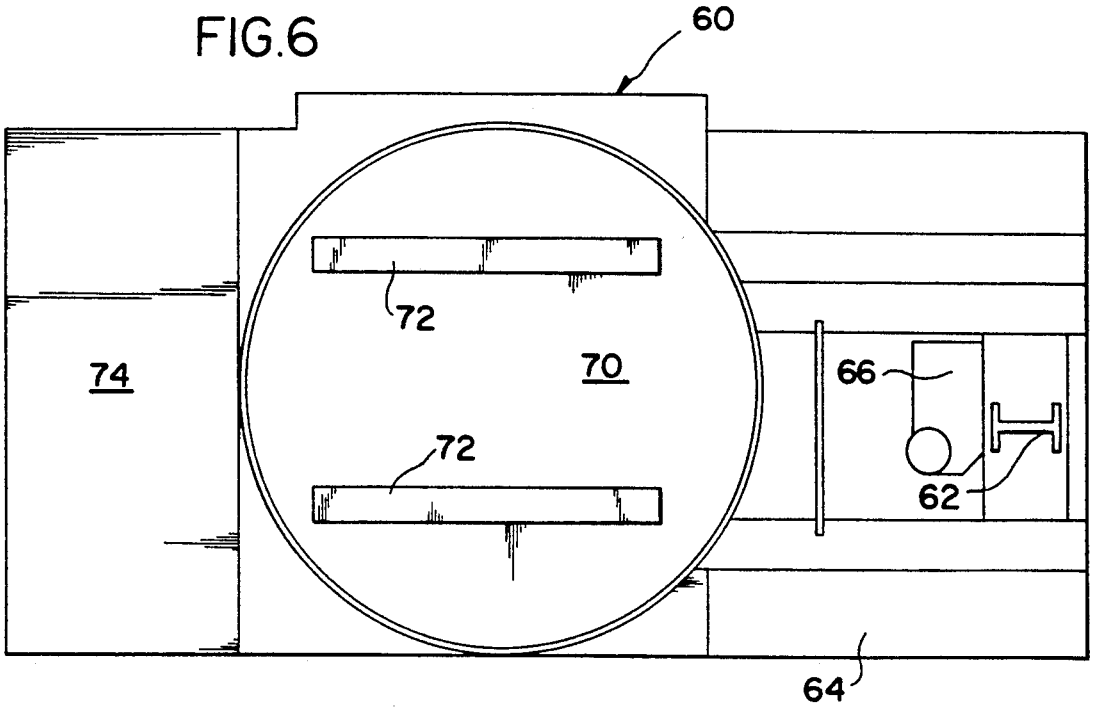
FIG. 6 is a top plan view of a wrapping machine according to the present invention.

After the six mattresses are mounted on the stand and received within base 24, flaps 42 and wall 40 are pivoted to their appropriate positions and secured by staples as shown in FIG. 4. After the base has been fully attached, a cap is formed and placed over the set of mattresses as shown in FIG. 5. With cap 26 receiving the upper ends of the six mattresses, edge supports 28 are stapled in position. In the condition illustrated in FIG. 5, the partially assembled package is ready to be lifted by a suitable device, such as a hand forklift, and transported to a wrapping machine 60 graphically illustrated in FIGS. 6 and 7.

Wrapping machine 60 can be of the type manufactured by Orion Packaging Inc. of Montreal, Canada and Memphis, Tenn. as the Orion L-66, low profile, heavy duty, semi-automatic stretch wrap machine. The machine includes a vertical support 62 and a horizontal support 64. The vertical support includes a wrap dispenser 66 including a roll 68 of wrapping material. Dispenser 66 dispenses the wrap under tension and is mounted on vertical support 62 by a suitable elevator drive mechanism to move up and down vertical support 62 in a controlled manner. Horizontal support 64 includes a turntable 70 having a suitable driving mechanism for rotating the turnable at a controlled speed of rotation. Boards 72 are mounted on turntable 70 to facilitate handling of the package by a forklift. A ramp 74 is located adjacent turntable 70 to facilitate movement of the forklift onto and off of the wrapping machine 60.

Figure 7:
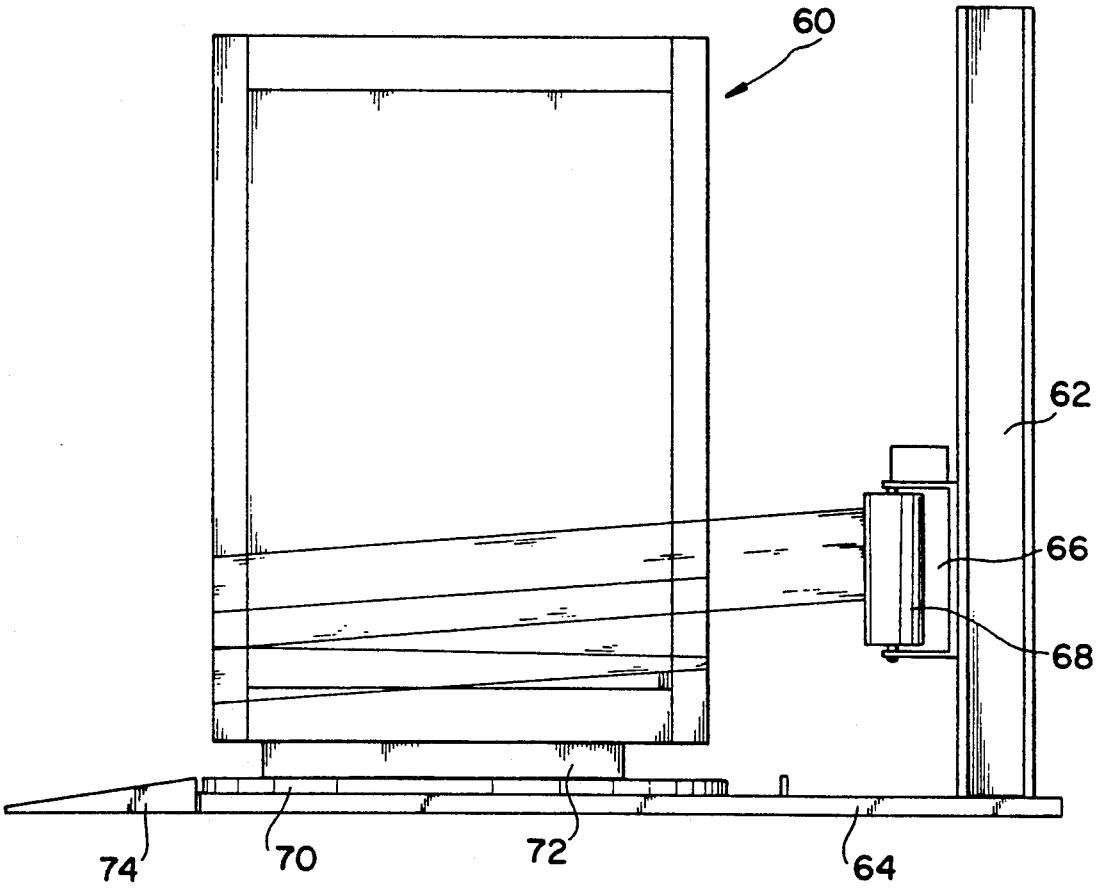
FIG. 7 is a side elevational view of the wrapping machine of FIG. 6 in the process of wrapping the package.

The partially assembled package, as illustrated in FIG. 5, is lifted off stand 50 and is placed on wrapping machine 60 as illustrated in FIG. 7. The package is supported on boards 72 on turntable 70. The free end 76 (FIG. 1) of the wrapping material from roll 68 is attached to the partially assembled package by securing it between the edge supports and the mattresses. The turntable is then rotated while dispenser 68 is moved up and down vertical support 62 to wrap the elastic plastic film in a spiral manner about the package.

In the wrapping operation, the sequence of vertical movement of dispenser 68 is suitably controlled such that a complete wrap around the lateral sides of the package occurs first around package adjacent the package bottom. After one complete pass about the bottom of the package, dispenser 68 moves upwardly, while the turntable continues to rotate to spirally wrap the package. As the package is being spirally wrapped, the mattresses will be compressed inwardly by the wrapping. At the top of the package, another complete wrapping of the package about each of its lateral sides is made. Subsequently, the machine traverses downwardly providing another layer of spiral wrapping about the package. After the wrapping is completed, the end of the wrap is cut to release the wrapping from roll 68. At this point, the completed package 10 is removed from wrapping machine 60 using a hand fork-lift truck.

The completed package is then available for storage and shipping in a suitable manner. To facilitate packing of the packages, the package can be mounted on a pallet, particularly for vertical stacking.

While a particular embodiment has been chosen to illustrate the invention, it will be understood by those skilled in the art that various changes and modifications can be made therein without departing from the scope of the invention as defined in the appended claims.

What is claimed is:

1. A mattress package, comprising:

a set of superposed mattresses having aligned upper and lower edges;

a base receiving said lower ends of said mattresses;

a cap receiving said upper ends of said mattress; and a wrapping of elastic material spirally wound about lateral sides of said set of said mattresses and compressing said mattresses.

2. A mattress package according to claim 1 wherein edge supports extend vertically between and are attached to said base and said cap.

3. A mattress package according to claim 2 wherein each of said edge supports comprises two perpendicularly oriented panels coupled along a vertical fold line.

4. A mattress package according to claim 3 wherein said panels of each said edge support overlie adjacent lateral sides of said set of mattresses.

5. A mattress package according to claim 1 wherein each of said cap and base comprises a rectangular central panel and four walls extending perpendicularly from said central panel.

6. A mattress package according to claim 1 wherein said elastic material comprises a thin plastic film sheet.

* * * * *